US006983503B2

(12) United States Patent
Ahn

(10) Patent No.: US 6,983,503 B2
(45) Date of Patent: Jan. 10, 2006

(54) APPARATUS FOR PACKING FREE TERMINAL CONVOLUTIONS OF SPRING ASSEMBLY USED IN MATTRESS

(75) Inventor: Sung Ho Ahn, Kyunggi-Do (KR)

(73) Assignee: Ace Bed Co., Ltd., Sungnam Kyunggi-Do (KR)

( * ) Notice: Subject to any disclaimer, the term of this patent is extended or adjusted under 35 U.S.C. 154(b) by 0 days.

(21) Appl. No.: 10/866,029

(22) Filed: Jun. 14, 2004

(65) Prior Publication Data

US 2005/0050640 A1 Mar. 10, 2005

(30) Foreign Application Priority Data

Sep. 9, 2003 (KR) ..... 10-2003-0063169
Apr. 30, 2004 (KR) ..... 10-2004-0030738

(51) Int. Cl.
*A47C 23/04* (2006.01)

(52) U.S. Cl. ..... 5/721; 5/716; 267/94

(58) Field of Classification Search ..... 5/235, 5/230, 258, 253, 716, 719, 720, 721; 267/94
See application file for complete search history.

(56) References Cited

U.S. PATENT DOCUMENTS 1,962,871 A * 6/1934 Leonard ..... 5/235
2,124,720 A * 7/1938 Hove ..... 5/235
2,276,516 A * 3/1942 Roy ..... 267/94
4,862,540 A * 9/1989 Savenije ..... 5/718
5,713,088 A * 2/1998 Wagner et al. ..... 5/716
6,036,181 A * 3/2000 Workman ..... 5/720
6,128,798 A * 10/2000 Barman et al. ..... 5/716
6,490,744 B1 * 12/2002 Schulz, Jr. ..... 5/720

* cited by examiner

*Primary Examiner*—Frederick L. Lagman
(74) *Attorney, Agent, or Firm*—Antonelli, Terry, Stout and Kraus, LLP.

(57) ABSTRACT

There is provided an innerspring assembly used in a mattress for absorbing external loads. An outermost coil spring 115 of a spring array 110 is secured in a space between upper and lower border wires 120 and 120' by pins 140, and helical coils 130 are disposed in row directions R on upper and lower portions of the spring array 110 to knit an adjacent coil spring 115, such that each coil spring has a free terminal convolution 115*a* protruded from an upper portion of the upper border wire 120 and/or a lower portion of the lower border wire 120'. The spring assembly includes an enclosure 10 partially or fully provided on an upper end portion and/or an lower end portion of the coil spring for covering the terminal convolution 115*a* in the row direction R or column direction L, thereby interrupting interference between the terminal convolution 115*a* and the upper and/or lower border wire 120 and 120' and absorbing a lateral load applied to the terminal convolution. A padding member is not damaged by the terminal convolution, and a contact resistance between the upper border wire and the terminal convolution is absorbed to block a frictional noise.

26 Claims, 20 Drawing Sheets

APPARATUS FOR PACKING FREE TERMINAL CONVOLUTIONS OF SPRING ASSEMBLY USED IN MATTRESS

TECHNICAL FIELD

The present invention relates to an innerspring assembly used in a mattress for absorbing external loads, and more particularly, to an apparatus for packing free terminal convolutions of a spring assembly used in a mattress, by which terminal convolutions exposed from an upper surface and/or a lower surface of the spring assembly are packaged to interrupt interference between the convolutions and a padding member.

BACKGROUND ART

Generally, a spring assembly having free terminal convolutions (hereinafter, referred to as spring assembly) is an elastic body to provide a cushion and shock-absorbing function together with padding members each layered on an upper surface and a lower surface of the spring assembly. The spring assembly is composed of a plurality of coil springs arranged in a side-by-side arrangement, usually in parallel columns and parallel rows.

In the case where coil springs are regularly arranged in upper and lower directions of upper and lower border wires which form the upper and lower surfaces of the spring assembly, the terminal convolutions of the coil springs are exposed in a given height from an upper portion of the upper border wire and/or a lower portion of the lower border wire.

As shown in FIG. 1, the spring assembly, generally indicated at 100, includes an array of springs 110 arranged in parallel columns C and parallel rows R, upper and lower border wires 120 and 120' disposed on upper and lower portions of the array of springs 110 for supporting the outermost coil springs 115, helical coils 130 engaged to the parallel row R of the array of springs 110 for fixing the terminal convolutions of the adjacent coil springs 115.

The coil springs 115 are arranged in a vertical direction, where they are fixed in a space between the upper and lower border wires 120 and 120' by means of sheet metal clips 140. The coil springs 115 have free terminal convolutions 115*a* exposed outwardly from the upper and/or lower border wires 120 and 120' at an upper end portion and/or a lower end portion of the body.

The coil springs 115 are fixed in the space between the upper and lower border wires 120 and 120', and the helical coils 130 are engaged to the upper and lower portions of the spring array 110 in the row directions R, thereby forming the free terminal convolutions 115*a* on the upper portion of the upper border wire 120 and/or the lower portion of the lower border wire 120'.

In the case where the terminal convolutions 115*a* of the coil springs 115 are exposed outwardly from the upper and lower border wires 120 and 120' on the basis of a transverse plane of the spring array 110, when the padding members 150, such as non-woven fabric or floss silk, are layered on the upper surface and the lower surface of the spring array 110 and are enclosed by a cover, as shown in FIG. 2, the padding member 150 and the terminal convolutions 115*a* are in contact with each other, thereby causing the padding member to be damaged.

In addition, if the terminal convolutions 115*a* are deflected to one direction by the external force applied to the mattress, the spring assembly 100 has a problem in that the resilient force of the coil spring 115 is deteriorated due to the load focused toward one point. The deflected terminal convolutions 115*a* are contacted with a periphery surface of the upper border wire 120 or the lower border wire 120', thereby producing a frictional noise.

DISCLOSURE OF THE INVENTION

Therefore, an object of the present invention is to solve the problems involved in the prior art, and to provide an apparatus for packing free terminal convolutions of a spring assembly used in a mattress, by which terminal convolutions exposed from an upper surface and/or a lower surface of the spring assembly are packaged to interrupt interference between the convolutions and a padding member.

In order to achieve the above object, there is provided a spring assembly for a mattress, in which an outermost coil spring of a spring array is secured in a space between upper and lower border wires by pins, and helical coils are disposed in row directions on upper and lower portions of the spring array to knit an adjacent coil spring, such that each coil spring has a free terminal convolution protruded from an upper portion of the upper border wire and/or a lower portion of the lower border wire, the spring assembly includes an enclosure partially or fully provided in the row direction or a column direction on an upper end portion and/or a lower end portion of the coil spring to cover the terminal convolution, thereby interrupting interference between the terminal convolution and the upper and/or lower border wire and absorbing a lateral load applied to the terminal convolution.

BRIEF DESCRIPTION OF THE DRAWINGS

The above objects, other features and advantages of the present invention will become more apparent by describing the preferred embodiment thereof with reference to the accompanying drawings, in which.

BEST MODE FOR CARRYING OUT THE INVENTION

Reference will now be made in detail to preferred embodiments of the present invention, examples of which are illustrated in the accompanying drawings.

Figure 9:
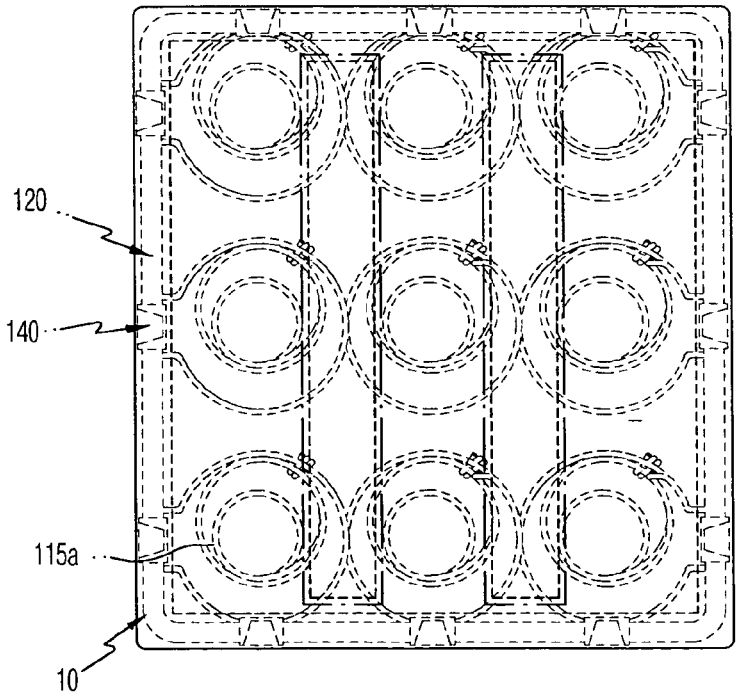
FIGS. 9 and 10 are cross-sectional views illustrating a non-woven fabric covering a spring assembly according to a preferred embodiment of the present invention, respectively.
Figure 10:
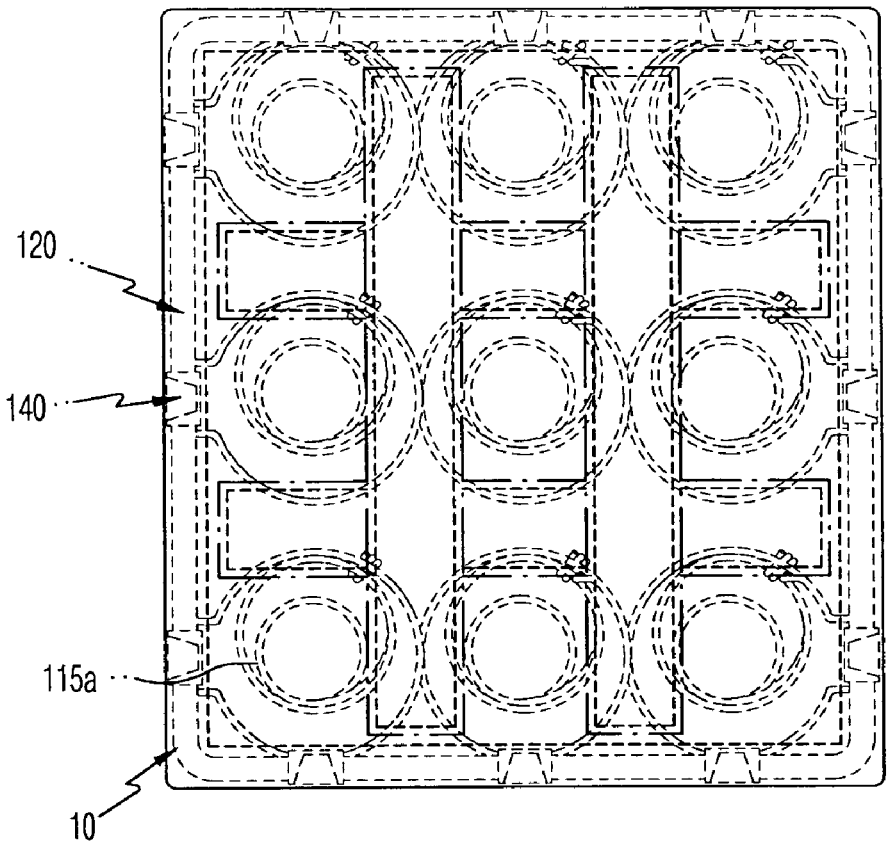
Figure 11A:
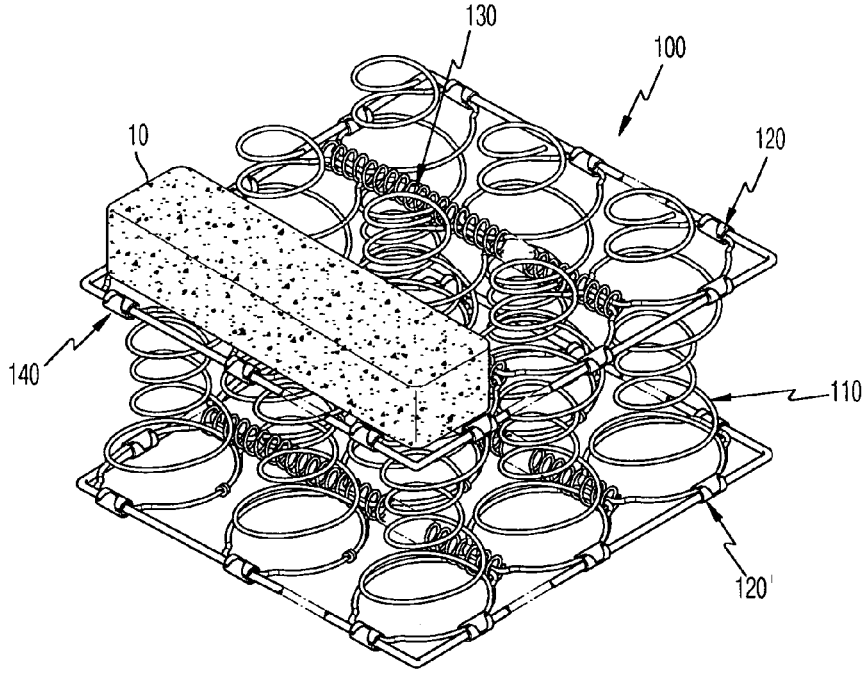
FIGS. 11 through 14 are cross-sectional views illustrating a molding of polyurethane foam disposed to a spring assembly according to a preferred embodiment of the present invention, respectively.
Figure 11B:
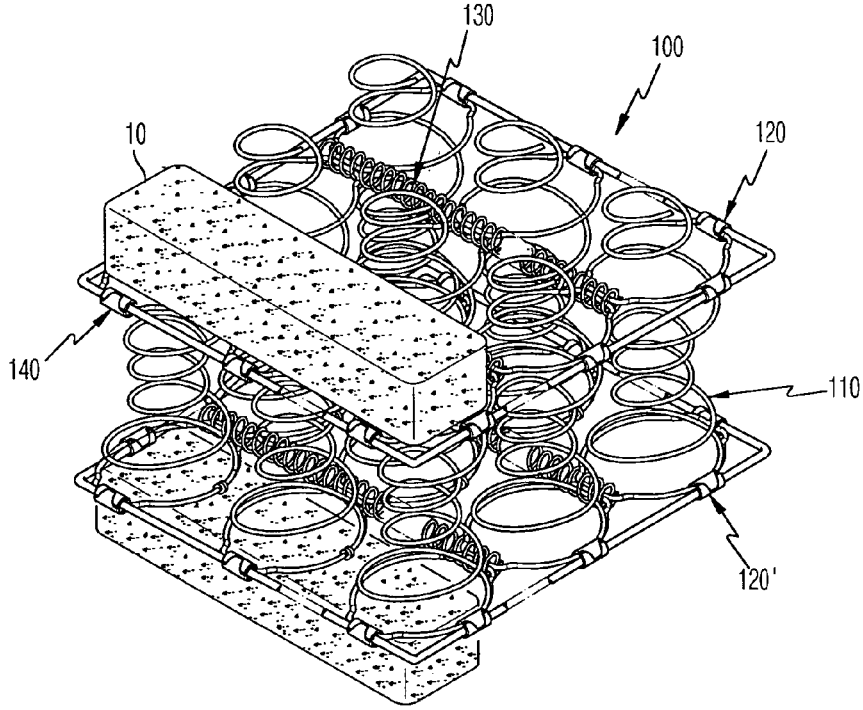
Figure 11C:
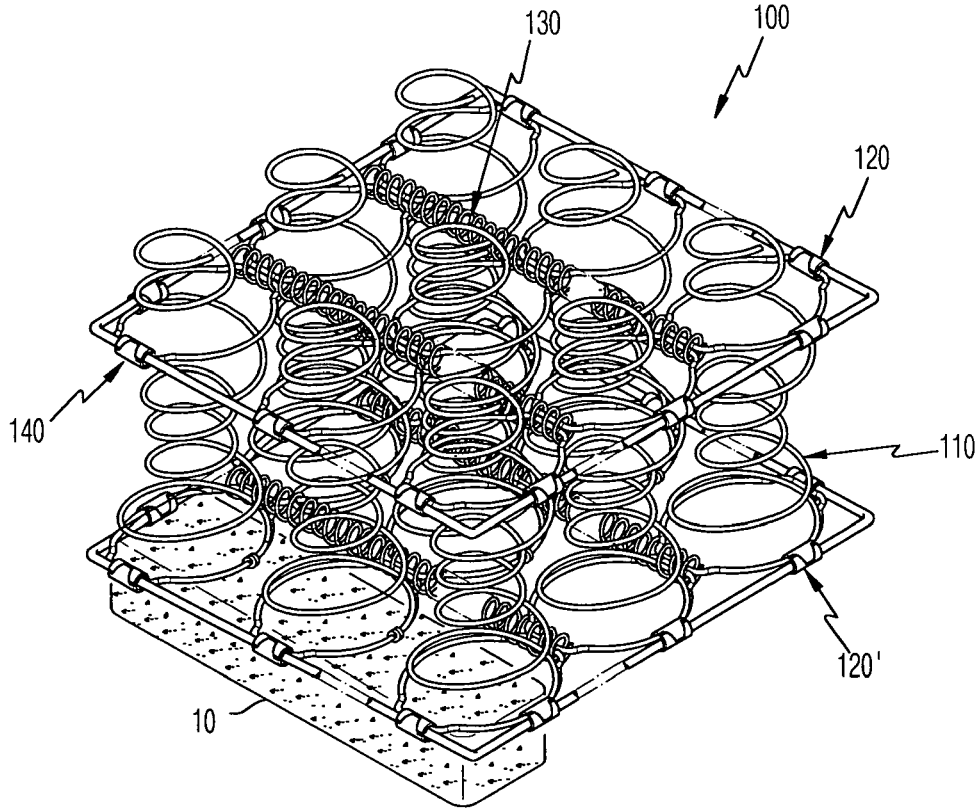
Figure 12A:
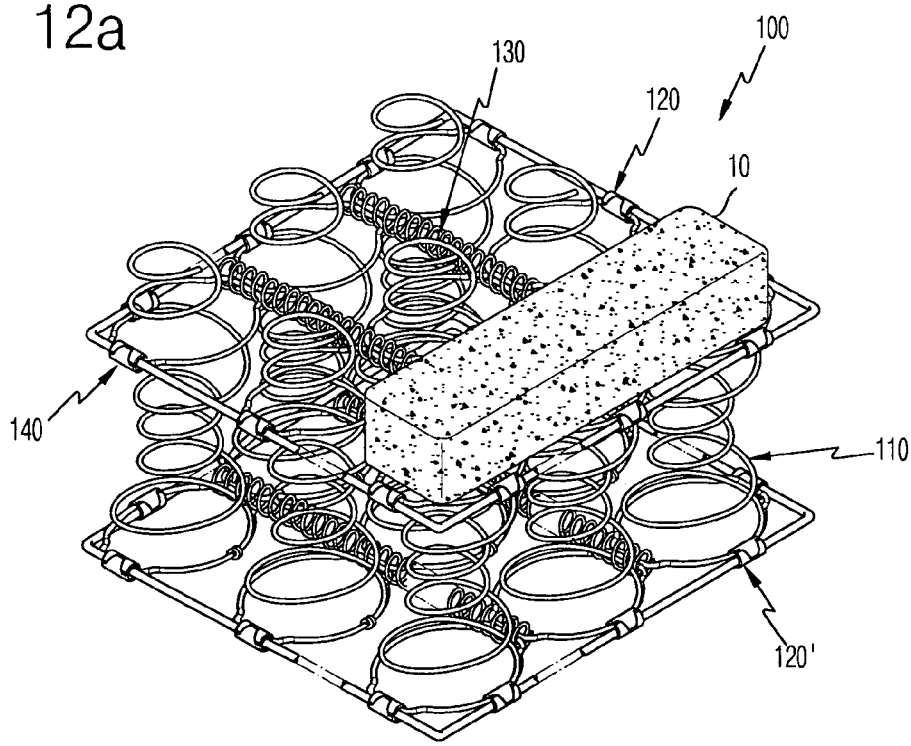
Figure 12B:
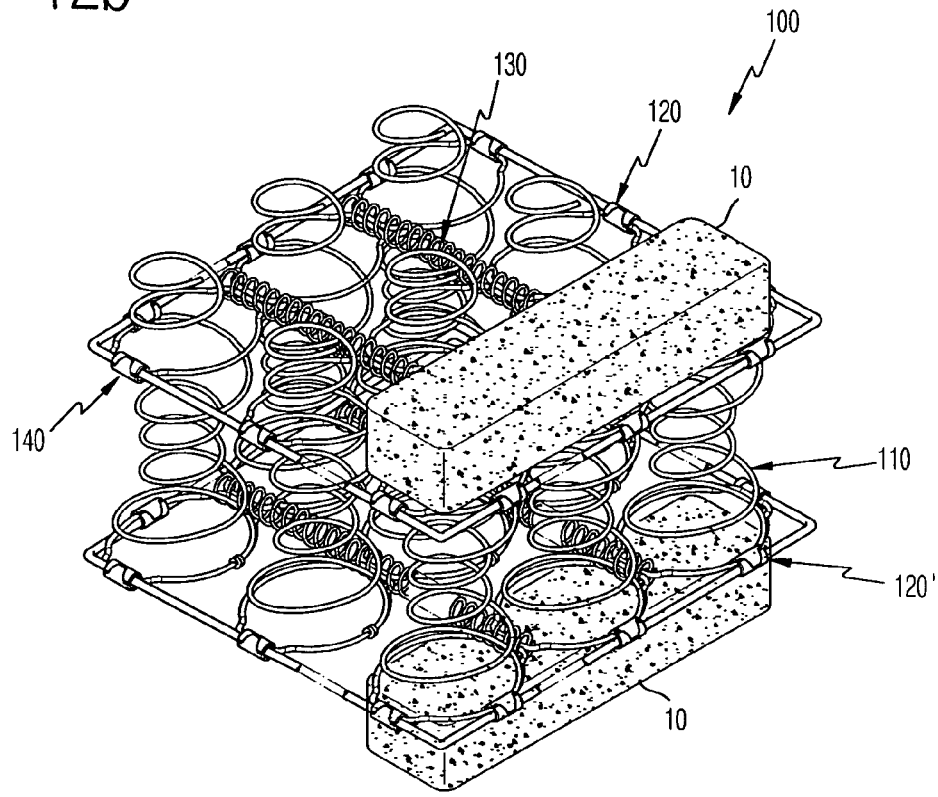
Figure 12C:
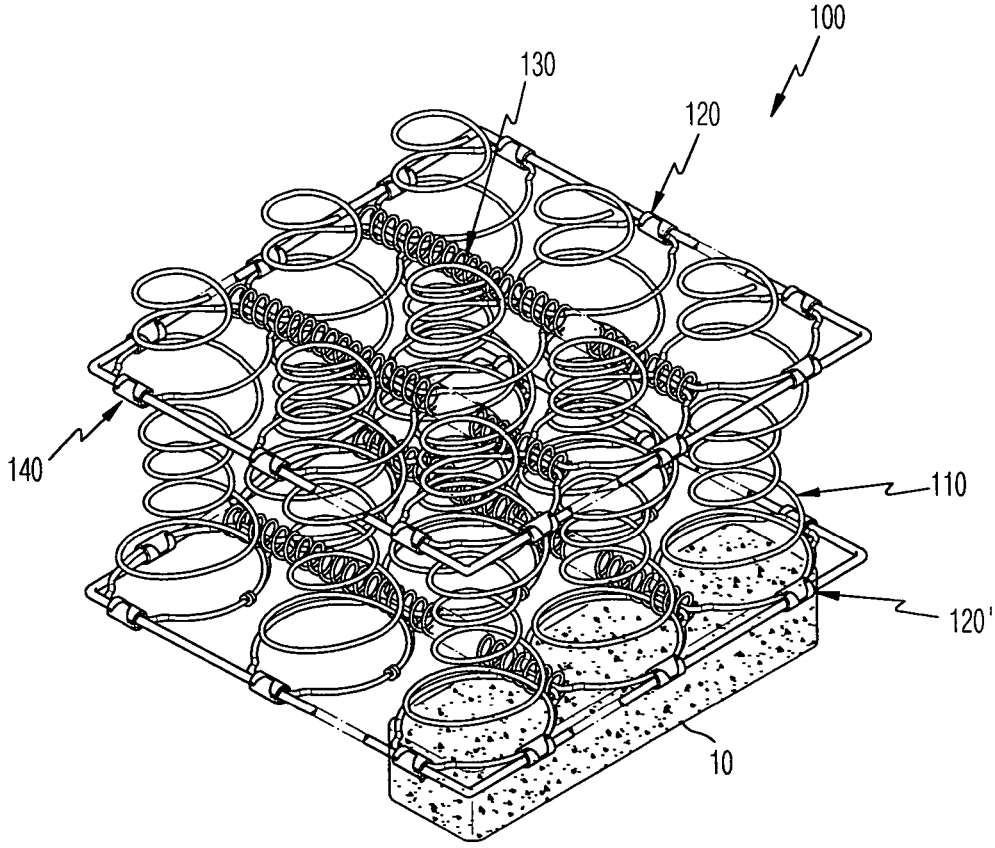
Figure 13A:
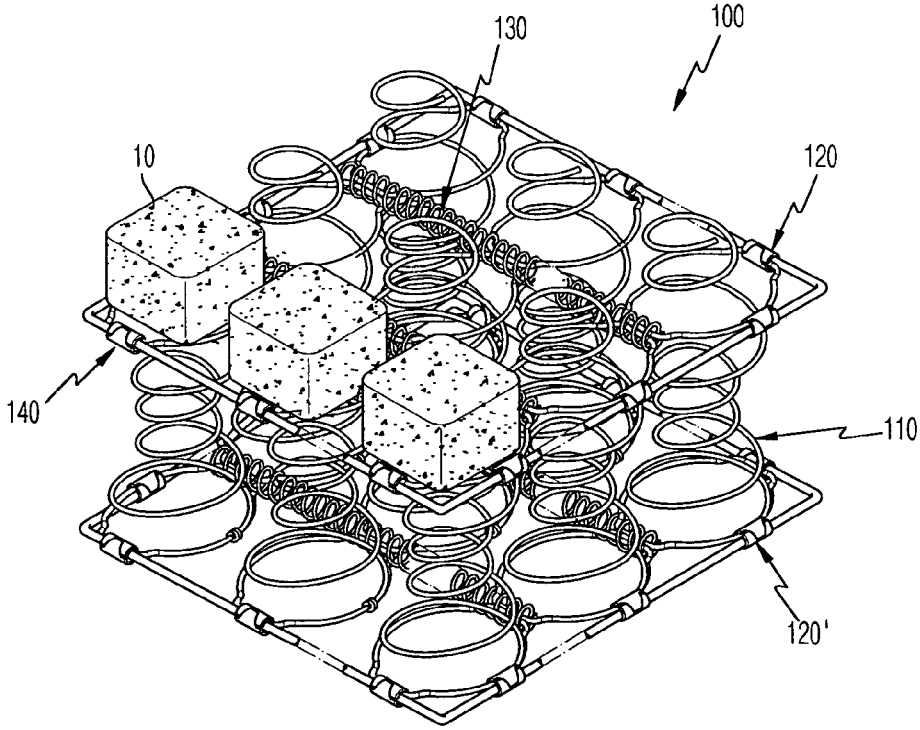
Figure 13B:
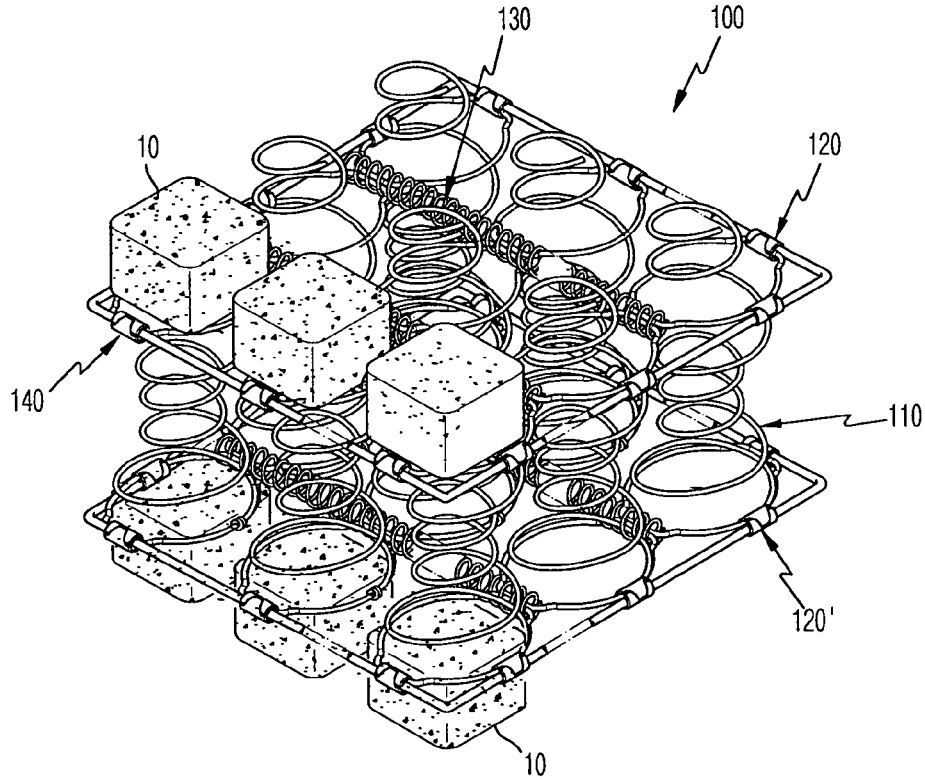
Figure 13C:
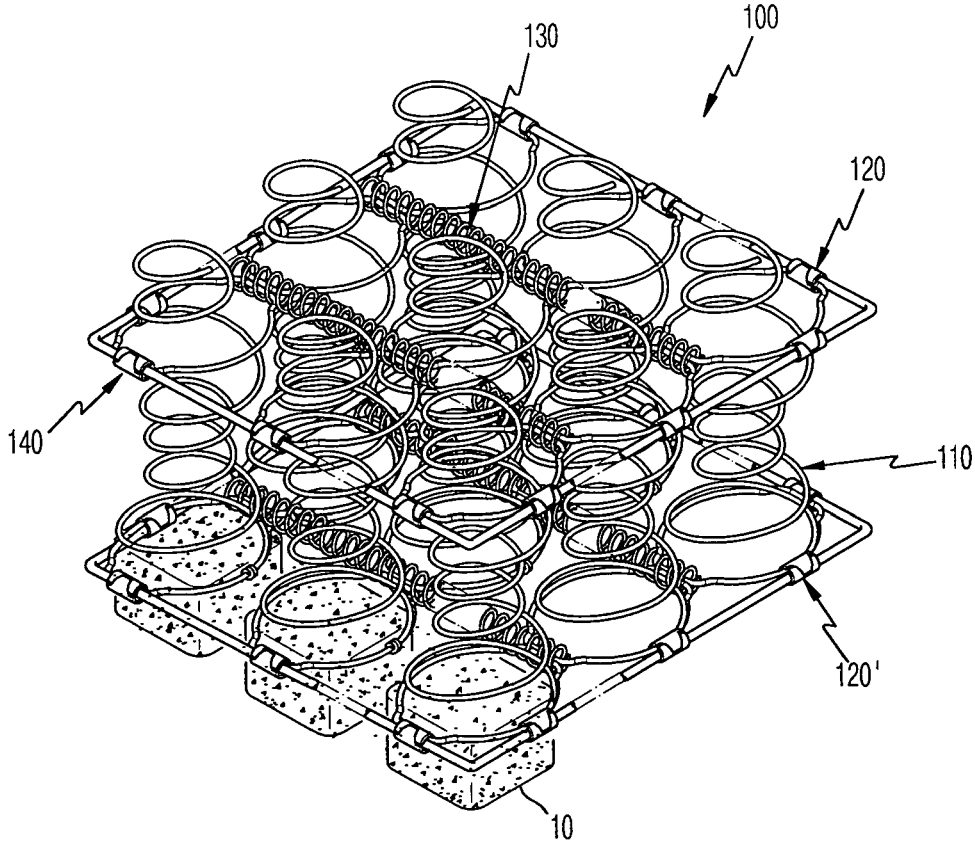
Figure 14A:
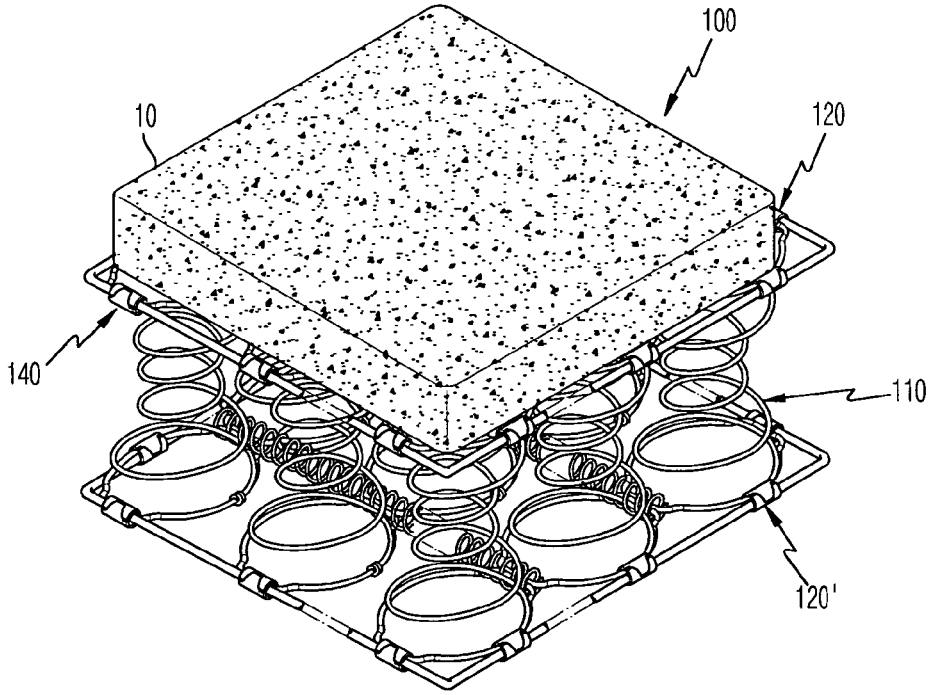
Figure 14B:
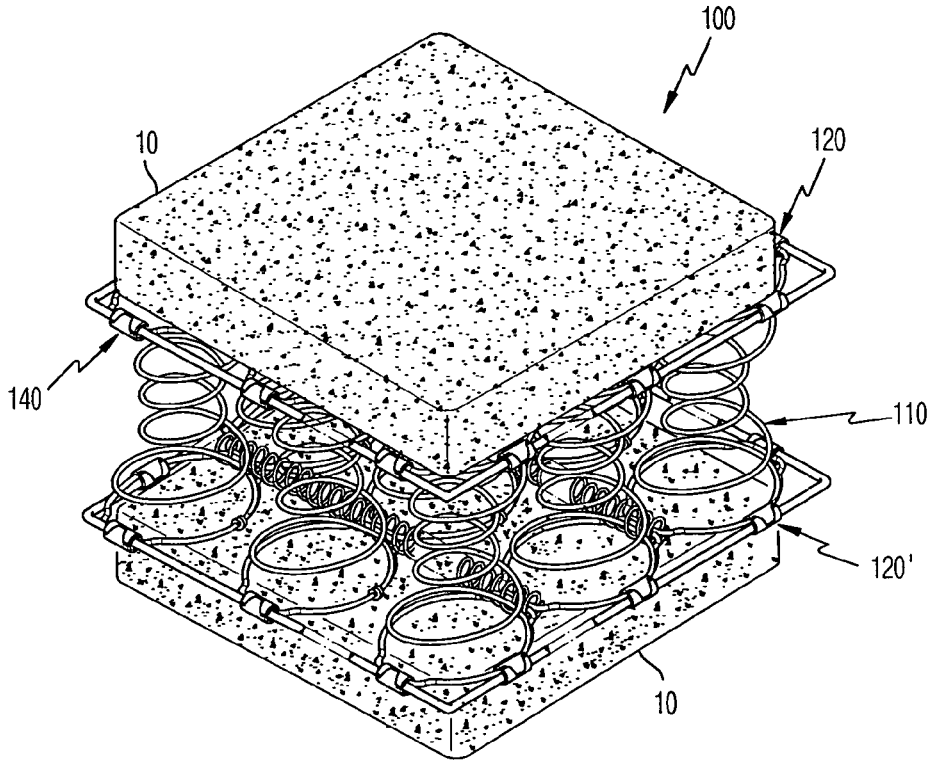
Figure 14C:
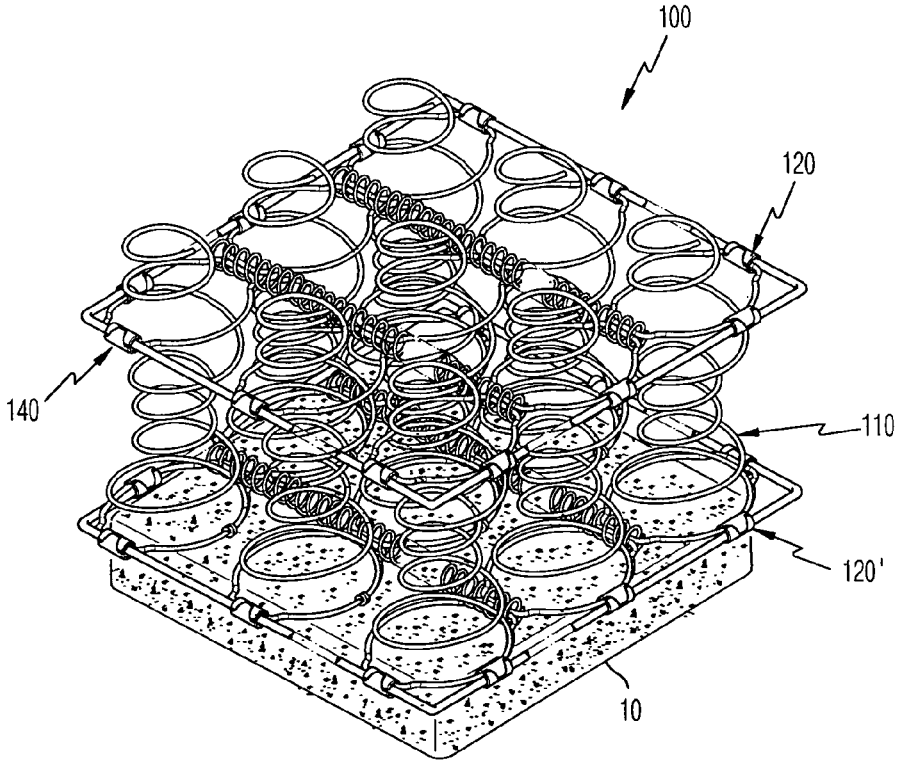

FIGS. 3 through 8 are cross-sectional views illustrating a non-woven fabric covering a spring assembly according to a preferred embodiment of the present invention, respectively. FIGS. 9 and 10 are cross-sectional views illustrating the non-woven fabric covering the spring assembly according to a preferred embodiment of the present invention, respectively. FIGS. 11 through 14 are cross-sectional views illustrating a molding of polyurethane foam disposed to a spring assembly according to a preferred embodiment of the present invention, respectively. An outermost coil spring 115 of a spring array 110 is secured in a space between upper and lower border wires 120 and 120' by pins 140, and helical coils 130 are disposed in row directions R on upper and lower portions of the spring array 110 to knit an adjacent coil spring 115, such that each coil spring has a free terminal convolution 115*a* protruded from an upper portion of the upper border wire 120 and/or a lower portion of the lower border wire 120'. An enclosure 10 is partially or fully provided in the row direction R or a column direction L on an upper end portion and/or an lower end portion of the coil spring to cover the terminal convolution 115*a*, thereby interrupting interference between the terminal convolution 115*a* and the upper and/or lower border wire 120 and 120' and absorbing a lateral load applied to the terminal convolution.

In components of the spring assembly 100 according to the present invention, the spring array 110, the upper and lower border wires 120 and 120' and the helical coil 130 have the same functions as those of components of a spring assembly, the description of which will be omitted herein. It will be described a difference between the present invention and the conventional spring assembly, the terminal convolution is covered by the enclosure 10.

The enclosure 10 is a member to cover the upper end portion or the lower end portion of the coil spring 115. Preferably, the enclosure 10 has a volume sufficient to wholly cover the terminal convolution 115*a*. In particular, the enclosure 10 may be any one of polyurethane foam and flexible non-woven fabric.

Although the embodiments are described with respect to the polyurethane foam and the non-woven fabric as the enclosure 10, any material to wholly cover the terminal convolution 115*a* and thus interrupt the interference between the padding member and the border wires can be employed.

Meanwhile, in the process of covering the terminal convolution 115*a* using the non-woven fabric as the enclosure 10, as shown in FIGS. 3 through 10, the non-woven fabric must be partially or fully provided in the row direction R or the column direction C on the upper end portion and/or the lower end portion of the coil spring for covering the terminal convolution 115*a* in the row direction R, and must be joined to an opposing side of the fabric.

Of course, when the non-woven fabric is enclosed around a circumference of the terminal convolution, one or more non-woven fabrics may be joined to each other to cover the terminal convolution 115*a*, and it would be apparent that a method of covering the terminal convolution using a non-woven fabric is covered by the scope of the present invention.

Figure 1:
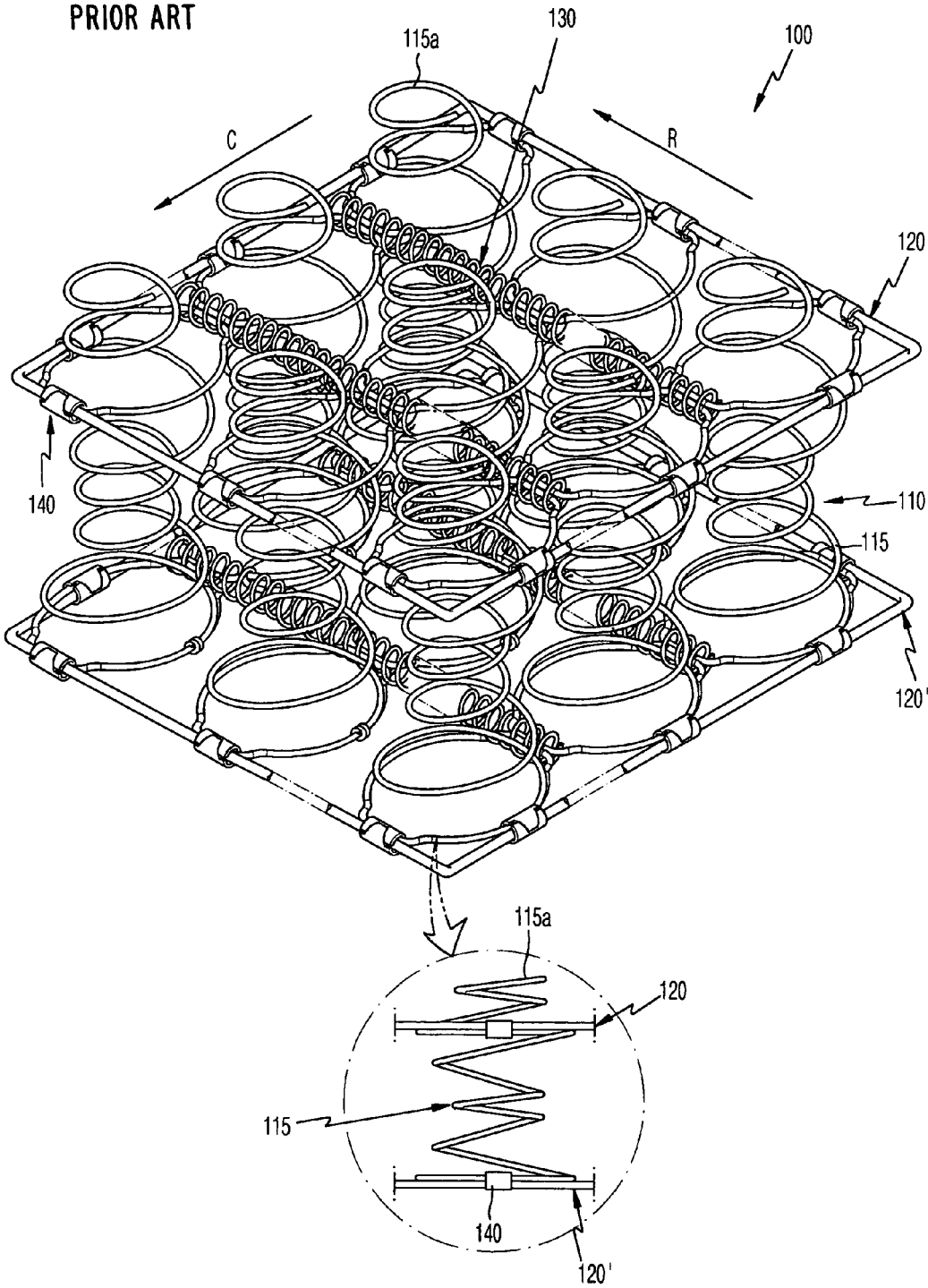
FIG. 1 PRIOR ART
FIG. 1 is a perspective view illustrating a conventional spring assembly.
Figure 2:
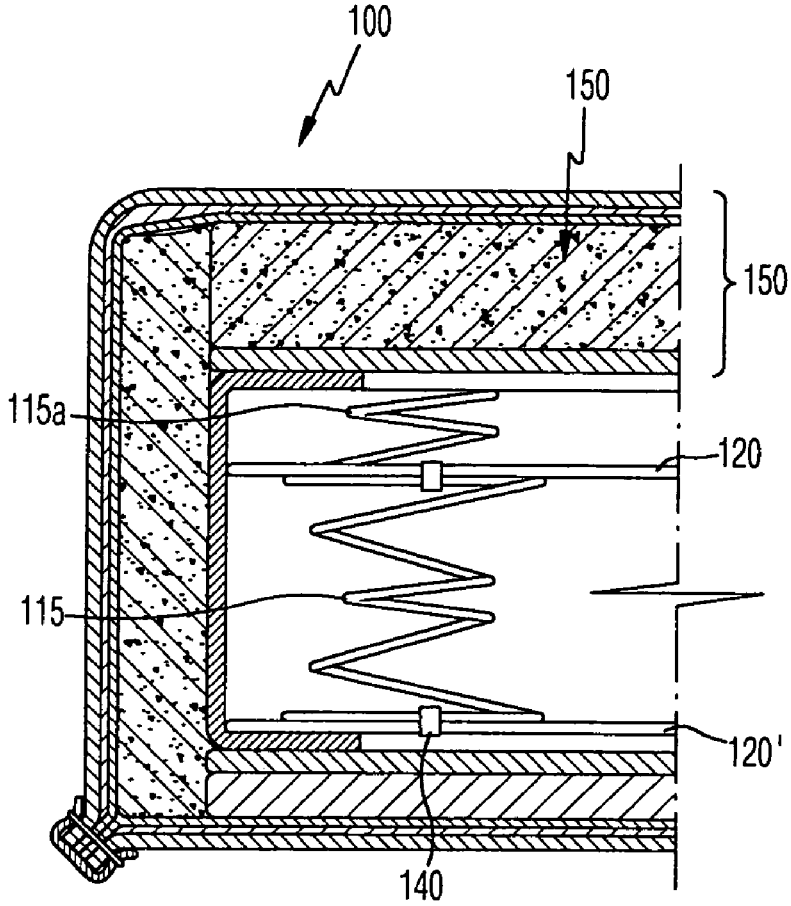
FIG. 2 PRIOR ART
FIG. 2 is a schematic view illustrating an application of a conventional spring assembly.
Figure 3A:
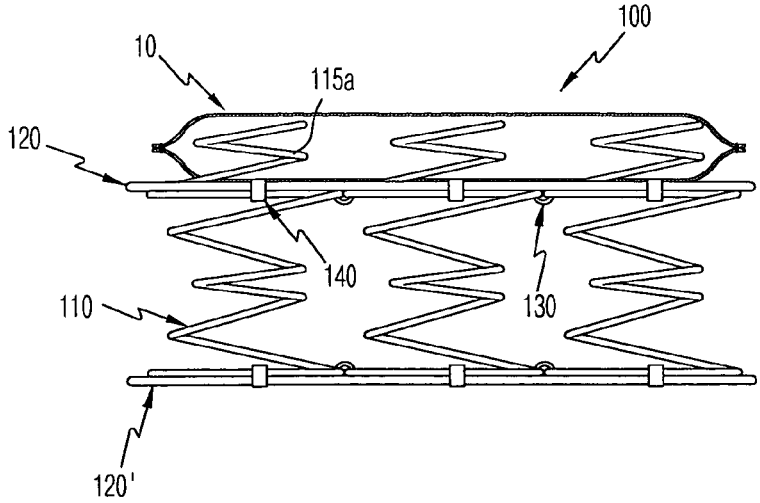
FIGS. 3 through 8 are cross-sectional views illustrating a non-woven fabric covering a spring assembly according to a preferred embodiment of the present invention, respectively.
Figure 3B:
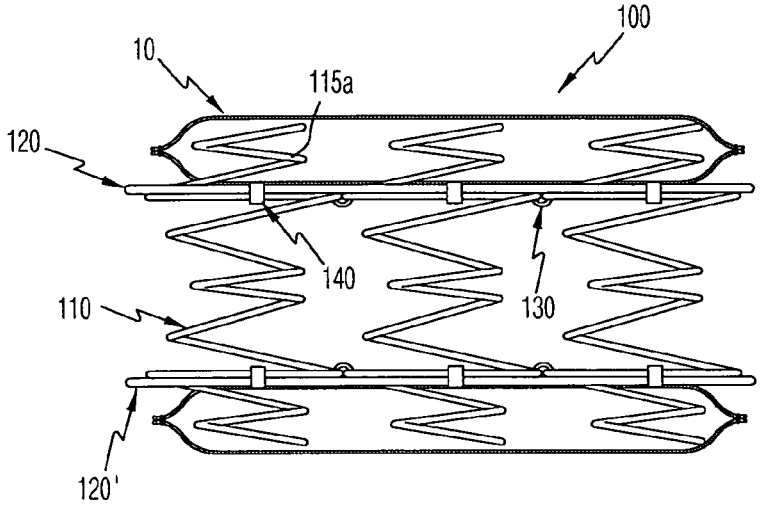
Figure 3C:
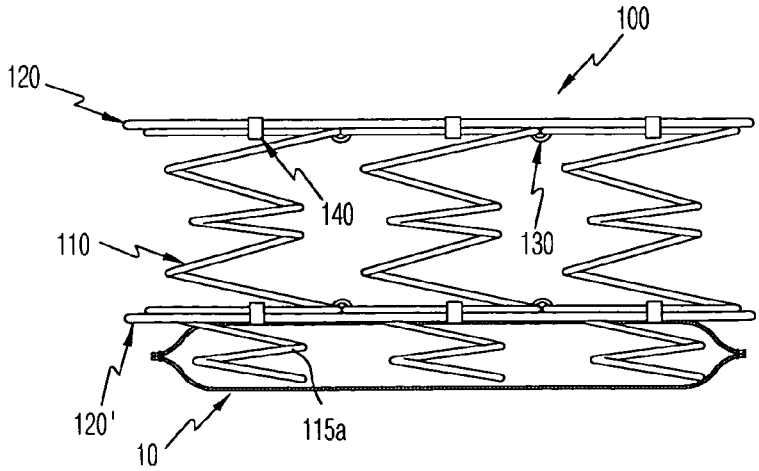

For example, as shown in FIG. 3, an upper non-woven fabric may cover the upper portion of the spring array 110 to fully enclose an upper portion of the terminal convolution 115*a*, and an end portion of the upper non-woven fabric may be tacked on or joined to a convolution of the terminal convolution 115*a*. Alternatively, as shown in FIGS. 9 and 10, an upper non-woven fabric may fully cover the upper portion of the spring array 110, and an end portion of the upper non-woven fabric may be tacked on or joined to the upper border wire 120 or the lower border wire 120'.

Figure 4A:
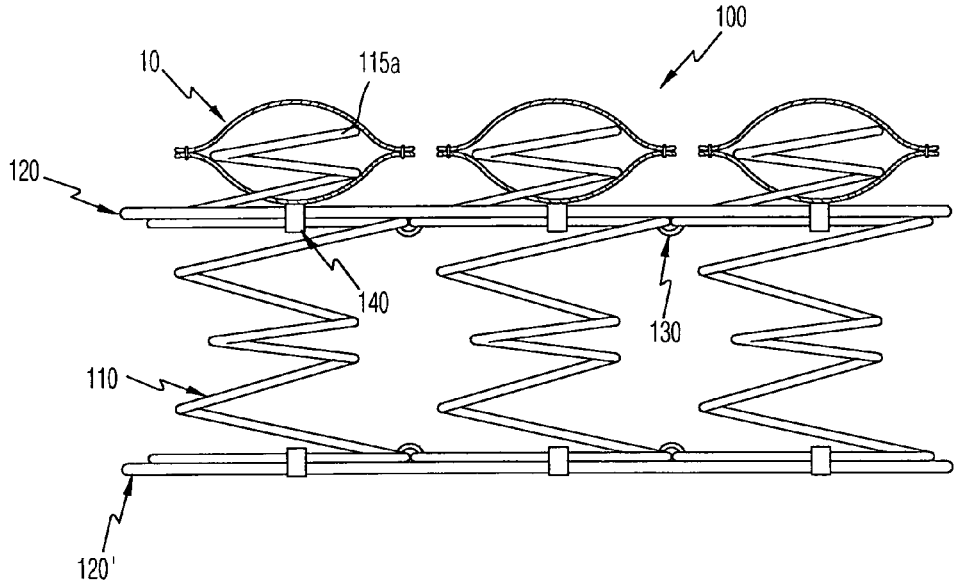
Figure 4B:
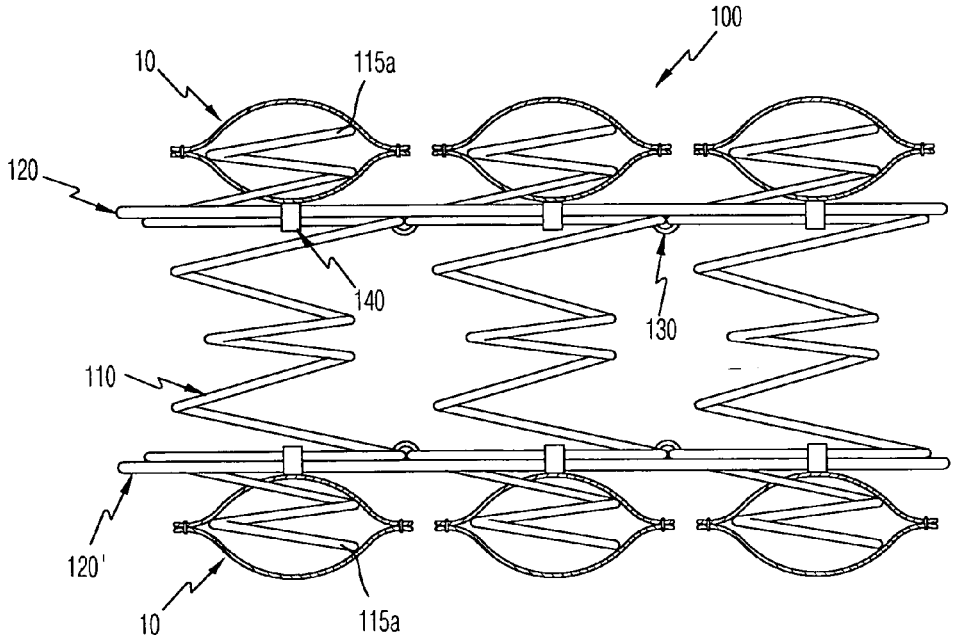
Figure 4C:
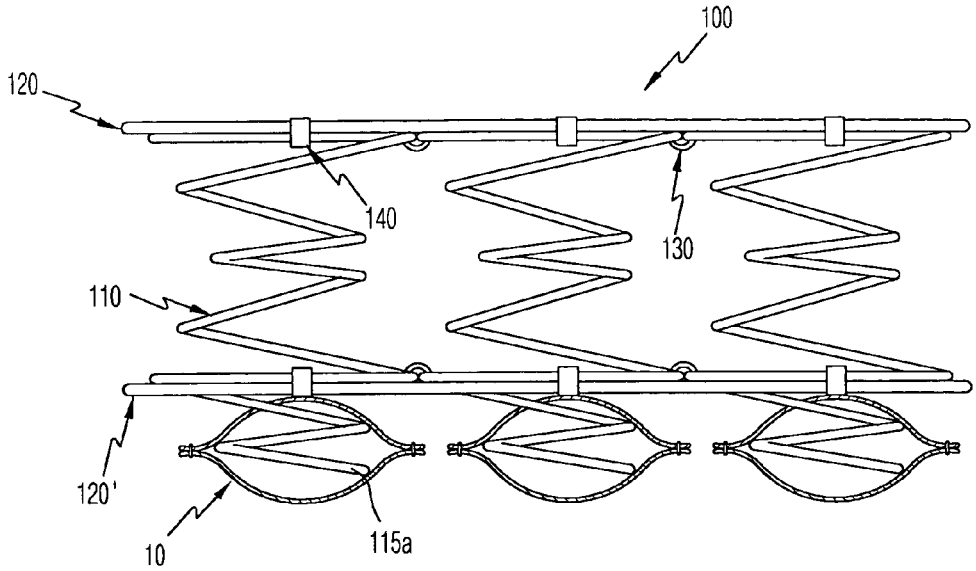
Figure 5A:
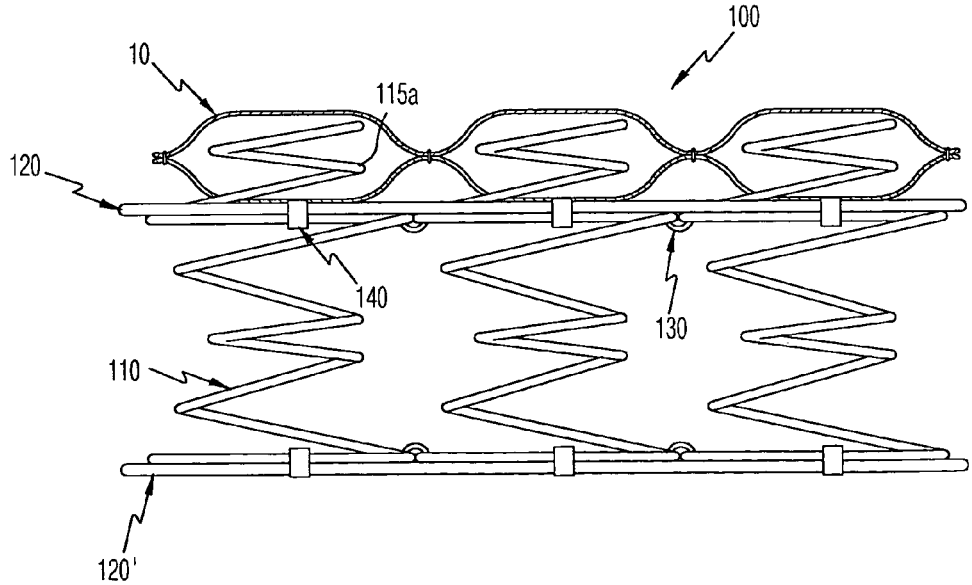
Figure 5B:
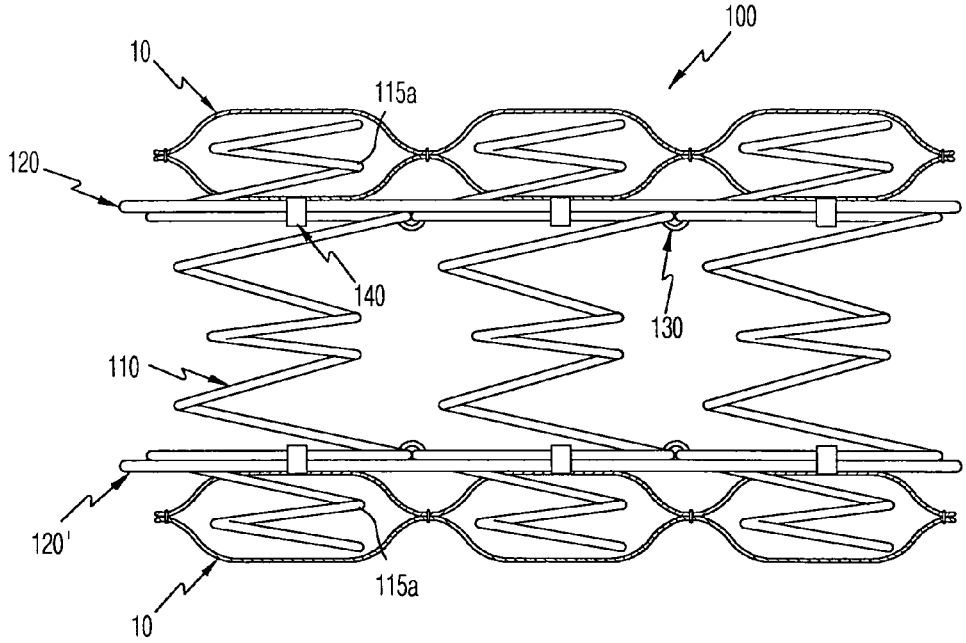
Figure 5C:
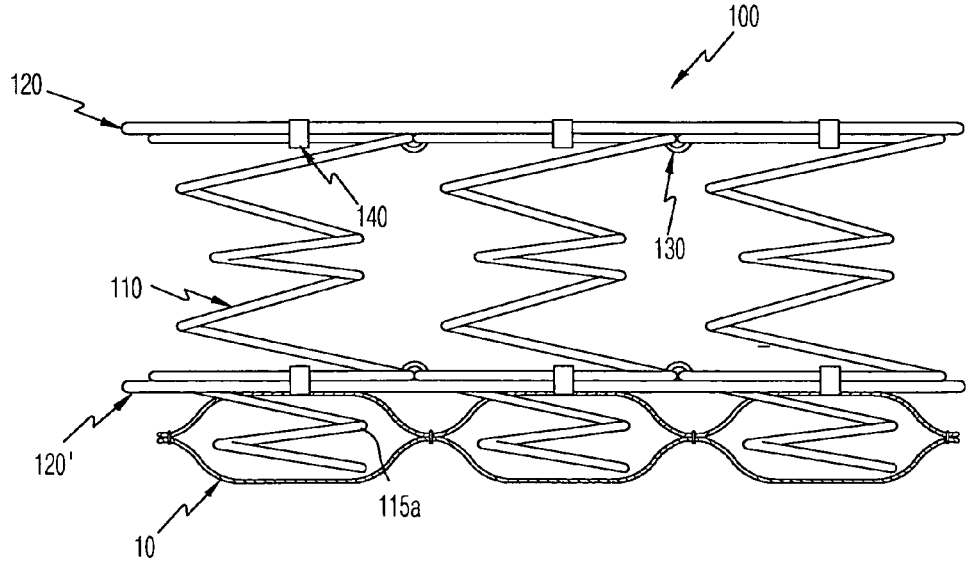

In addition, as shown in FIGS. 4 and 5, a lower non-woven fabric may be disposed in the row direction R under a lower portion of the terminal convolution 115*a*, and an upper non-woven fabric may be disposed in the row direction R on an upper portion of the terminal convolution 115*a*, such that the upper non-woven fabric may be tacked on or joined to the lower non-woven fabric. Alternatively, a lower non-woven fabric may be disposed in a column direction C under a lower portion of the terminal convolution 115*a*, and an upper non-woven fabric may be disposed in the column direction C on an upper portion of the terminal convolution 115*a*, such that the upper non-woven fabric may be tacked on or joined to the lower non-woven fabric.

At this time, as shown in FIG. 4, the upper non-woven fabric and the lower non-woven fabric may be cut by a piece, and enclose the terminal convolution 115*a* in the row direction R or column direction C. Alternatively, as shown in FIG. 5, the upper non-woven fabric and the lower non-woven fabric may enclose the terminal convolution 115*a* in the row direction R or column direction C, without cutting them.

Figure 6A:
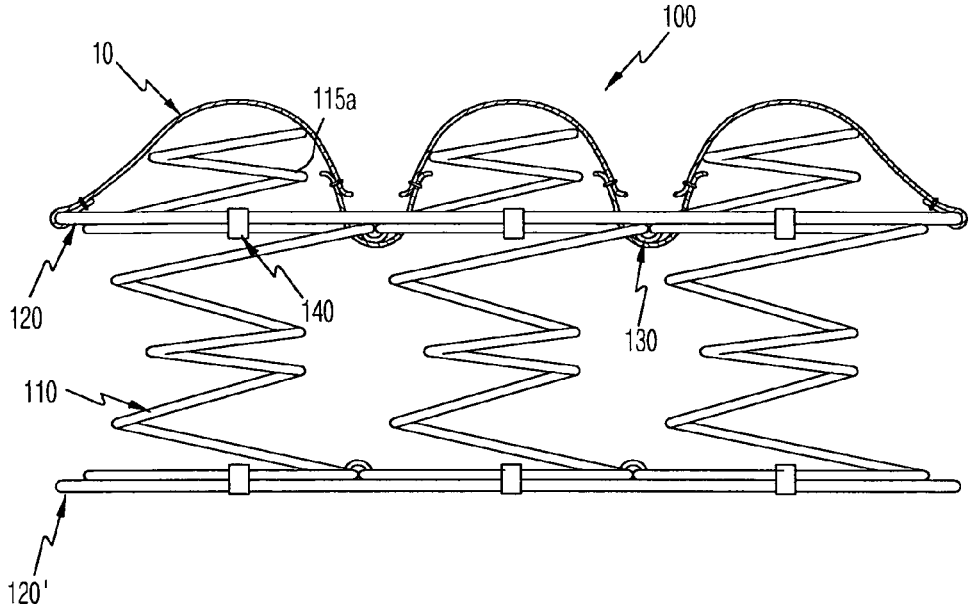
Figure 6B:
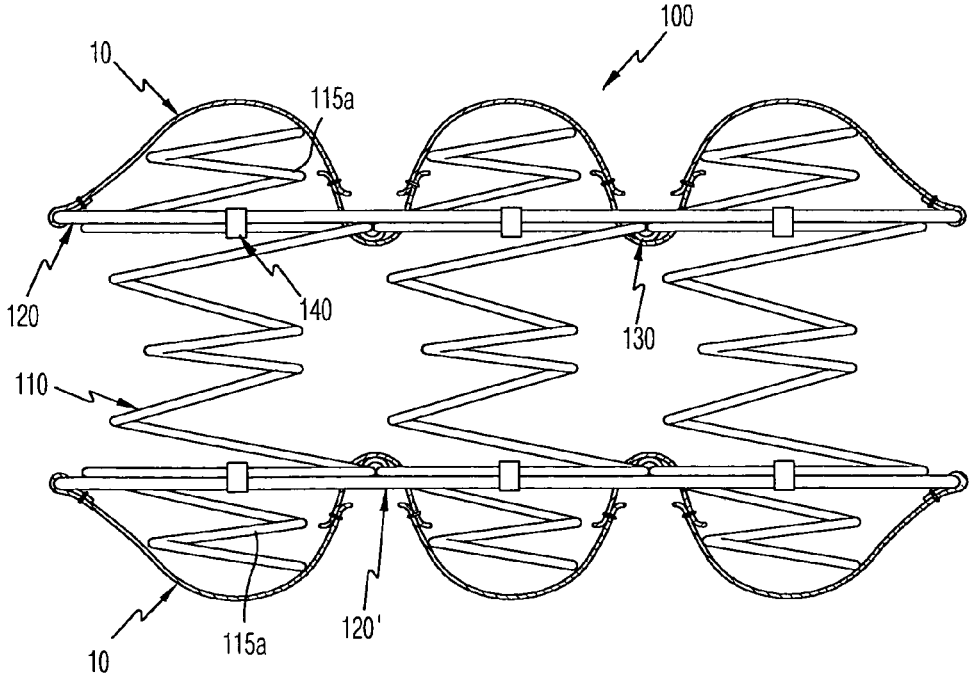
Figure 6C:
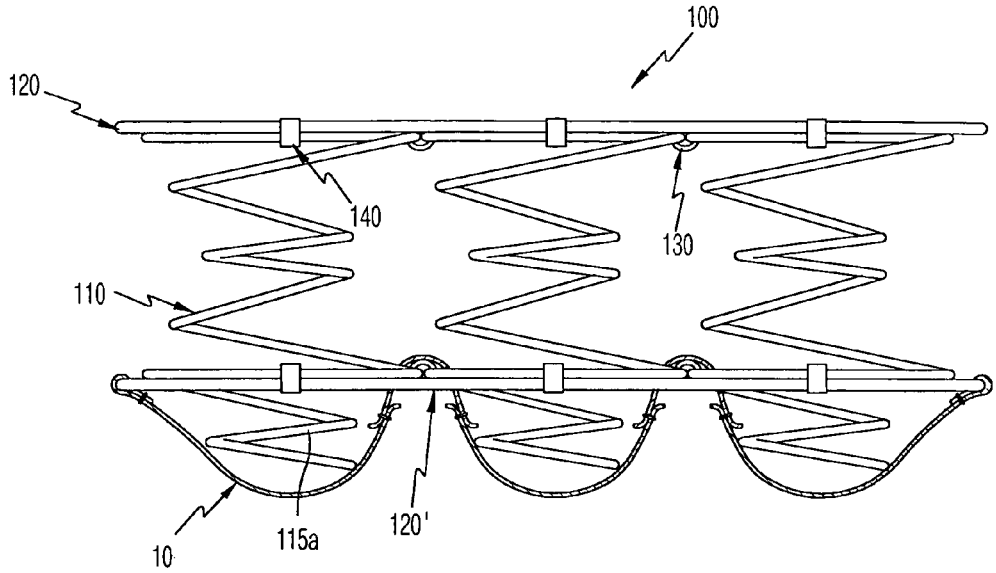
Figure 7A:
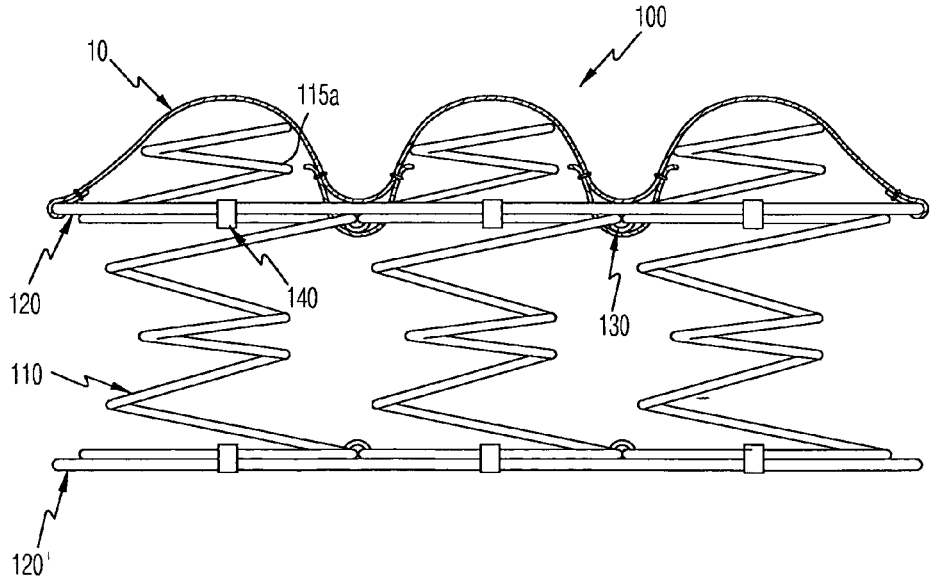
Figure 7B:
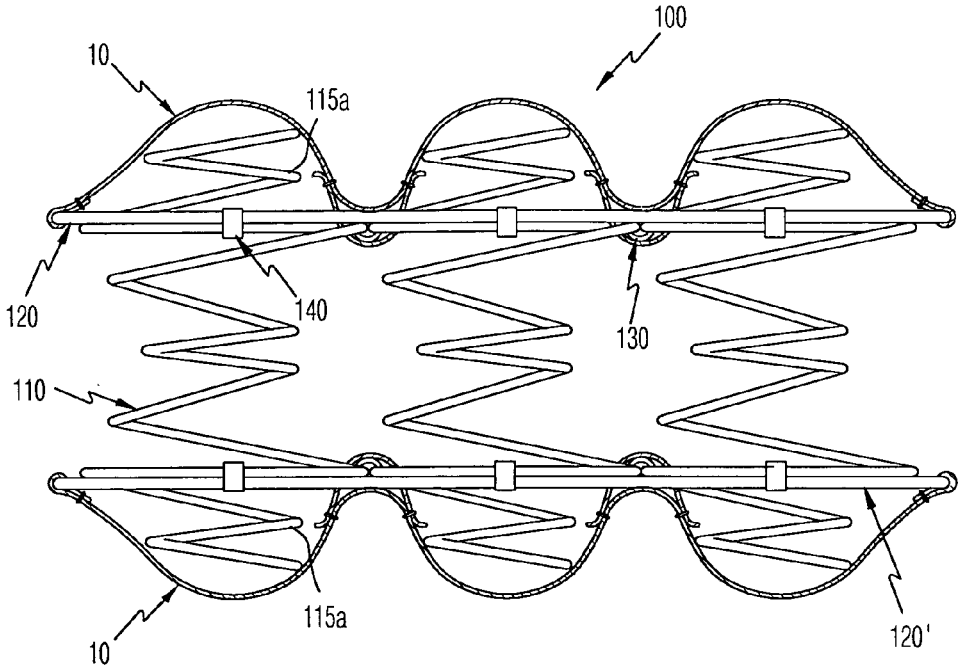
Figure 7C:
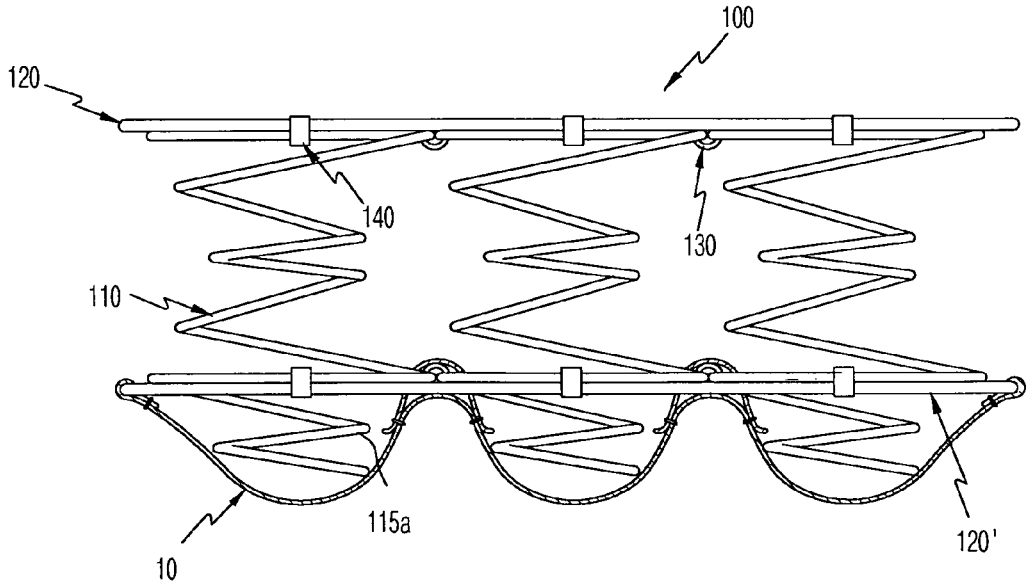

Furthermore, as shown in FIGS. 6 and 7, a lower non-woven fabric may be disposed in the row direction R under a lower portion of the helical coil 130, and an upper non-woven fabric may be disposed in the row direction R on an upper portion of the terminal convolution 115*a*, such that the upper non-woven fabric may be tacked on or joined to the lower non-woven fabric. Alternatively, a lower non-woven fabric may be disposed in the column direction C under a lower portion of the helical coil 130, and an upper non-woven fabric may be disposed in the column direction C on an upper portion of the terminal convolution 115*a*, such that the upper non-woven fabric is tacked on or joined to the lower non-woven fabric.

At this time, the lower non-woven fabric is disposed at a position adjacent to the helical coil 130 or the spring array, and then the upper non-woven fabric is cut by a piece, as shown in FIG. 6, or the upper non-woven fabric is continuously used without cutting it, as shown in FIG. 7.

Figure 8A:
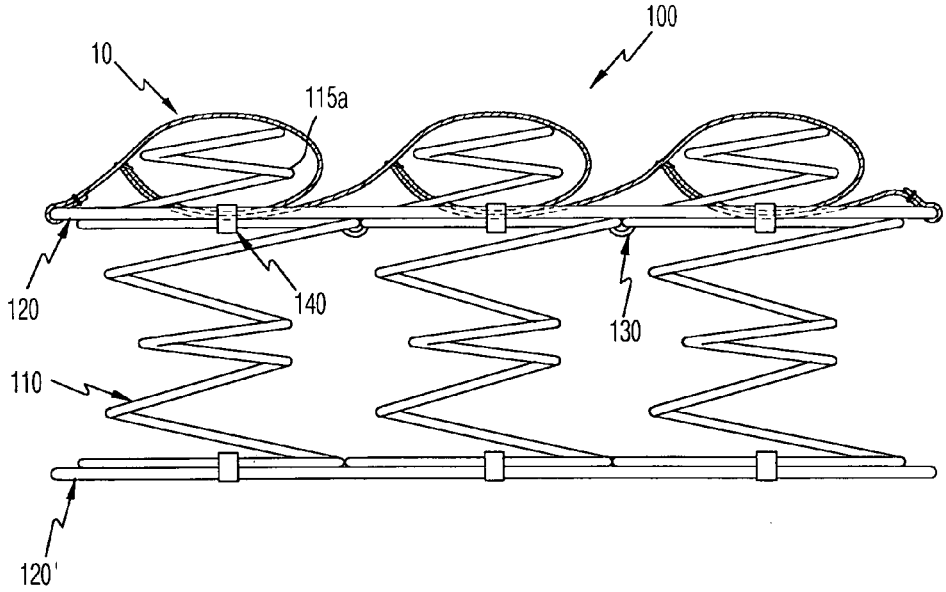
Figure 8B:
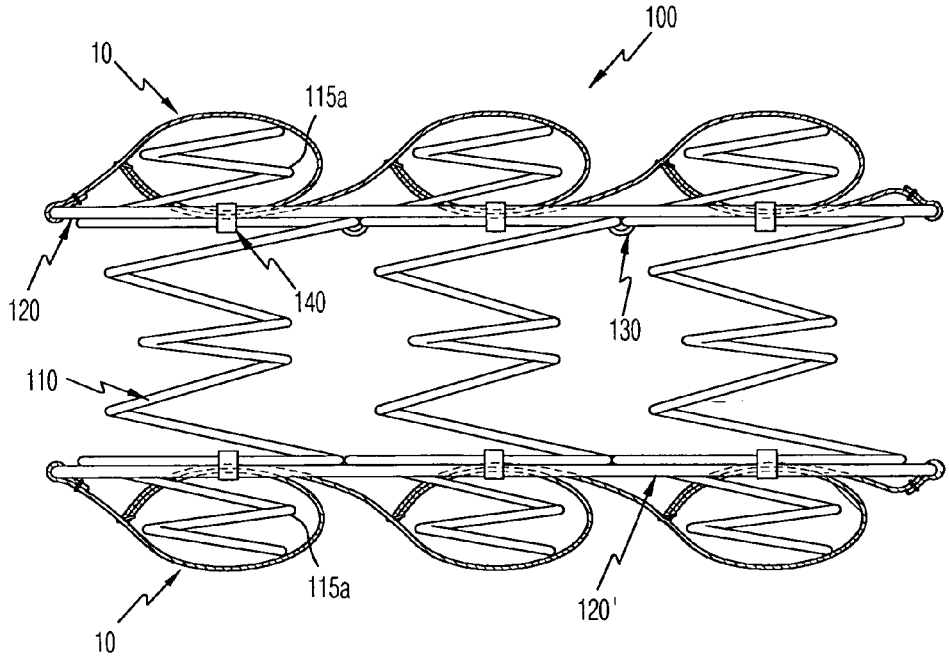
Figure 8C:
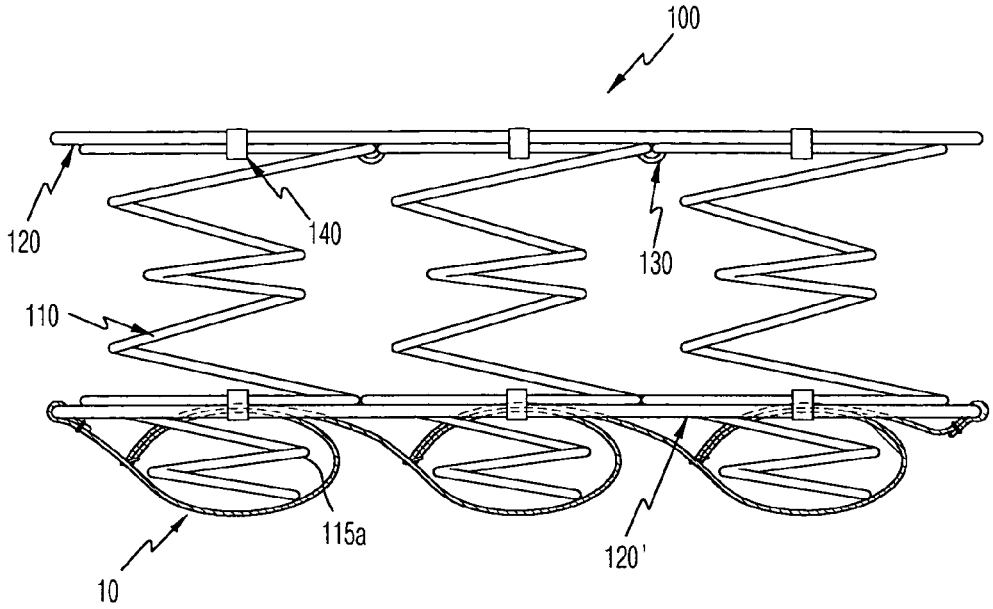

As shown in FIG. 8, an upper non-woven fabric may be faced to another non-woven fabric to cover an upper portion of the terminal convolution 115*a* along the row direction R, and a front end portion of the upper non-woven fabric may be wound around the terminal convolution to cover a lower portion of the terminal convolution 115*a*, such that the upper non-woven fabric may be tacked on or joined to an adjoining surface of the upper non-woven fabric. Alternatively, an upper non-woven fabric may be faced to another non-woven fabric to cover an upper portion of the terminal convolution 115*a* along the column direction C, and a front end portion of the upper non-woven fabric may be wound around the terminal convolution to cover a lower portion of the terminal convolution 115*a*, such that the upper non-woven fabric may be tacked on or joined to an adjoining surface of the upper non-woven fabric.

As shown in FIGS. 11 through 14, in the course of enclosing the terminal convolution 115*a* using the polyurethane foam as the enclosure 10, a wanted portion of the spring assembly 100, i.e., the terminal convolution 115*a* of the coil spring 115 is inserted into a mould (not shown) and is set at a given temperature during a predetermined time to partially or fully foam the terminal convolution 115*a* in the column direction C or row direction R.

In addition, in the course of enclosing the terminal convolution 115*a* of the coil spring 115 using the non-woven fabric shown in FIGS. 3 through 10 or the polyurethane foam shown in FIGS. 11 through 14, the terminal convolution 115*a* of the upper portion of the spring array 110 is partially or fully enclosed in the row direction R or the column direction C, and then the terminal convolution 115*a* of the lower portion of the spring array 110 is partially or fully enclosed in the row direction R or the column direction C.

The operation of the present invention will now be described.

First, in the case where the terminal convolution 115*a* of the spring assembly 100 is enclosed by the upper and lower non-woven fabrics, the upper and lower non-woven fabrics enclose around the terminal convolution 115*a* at a start point and an end point, and then adjoining surfaces are tacked on or joined to the lower non-woven fabric.

As shown in FIGS. 3 through 10, in the case where the terminal convolution 115*a* of the coil spring 115 is enclosed by the polyurethane foam, the terminal convolution 115*a* of the coil spring 115 is inserted into a mould (not shown) and is set at a given temperature during a predetermined time.

As such, the enclosure 10, such as non-woven fabric or polyurethane foam, is secured to any one of the upper and lower portions of the spring assembly 100. Specifically, the enclosure 10 is partially or fully secured in the row direction R or column direction C to the terminal convolution 115*a* of the coil spring 115.

Then, each padding member 150 is deposited on the upper and lower surfaces of the spring assembly 100, and is enclosed by the upper and lower cover and is sewed, thereby completing the process of manufacturing the mattress.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

INDUSTRIAL APPLICABILITY

With the above description, the enclosure of the non-woven fabric or the polyurethane foam is secured to the upper portion of the spring assembly, thereby protecting the padding member directly contacted with the circumference of the enclosure.

As such, if a weight of user is applied to the spring assembly in use, the enclosure interrupts the contact between the terminal convolution and the padding member, and an inclination of the terminal convolution is minimized, thereby blocking the frictional noise.

In addition, the padding member layered on the spring assembly is in surface contact with the enclosure enclosing the circumference of the terminal convolution, the terminal convolution does not interfere with the padding member, thereby preventing the friction therebetween and thus prolong a life of the mattress.

What is claimed is:

1. A spring assembly for a mattress, in which an outermost coil spring of a spring array is secured in a space between upper and lower border wires and by pins, and helical coils are disposed in row directions on upper and lower portions of the spring array to knit an adjacent coil spring, such that each coil spring has a free terminal convolution protruded from an upper portion of the upper border wire and/or a lower portion of the lower border wire, the spring assembly comprising:

an enclosure provided in the row direction on an upper end portion and/or a lower end portion of the coil spring for covering the terminal convolution from the adjoining border wire to the free end of the terminal convolution protruded therefrom, thereby interrupting interference between the terminal convolution and the upper and/or lower border wire and underlying coil spring and absorbing a lateral load applied to the terminal convolution.

2. The spring assembly as claimed in claim 1, wherein the enclosure is any one of polyurethane foam and non-woven fabric.

3. The spring assembly as claimed in claim 1, wherein the enclosure is a non-woven fabric, and the non-woven fabric includes a lower non-woven fabric disposed in the row direction under a lower portion of the terminal convolution and an upper non-woven fabric disposed in the row direction on an upper portion of the terminal convolution, in which the upper non-woven fabric is tacked on or joined to the lower non-woven fabric.

4. The spring assembly as claimed in claim 1, wherein the enclosure is a non-woven fabric, and the non-woven fabric includes a lower non-woven fabric disposed in the row direction under a lower portion of the helical coil and an upper non-woven fabric disposed in the row direction on an upper portion of the terminal convolution, in which the upper non-woven fabric is tacked on or joined to the lower non-woven fabric.

5. The spring assembly as claimed in claim 1, wherein the enclosure is a non-woven fabric, and the non-woven fabric includes an upper non-woven fabric faced to another non-woven fabric to cover an upper portion of the terminal convolution along the row direction, in which a front end portion of the upper non-woven fabric is wound around the terminal convolution to cover a lower portion of the terminal convolution and is tacked on or joined to an adjoining surface of the upper non-woven fabric and which another terminal convolution is covered in the same manner.

6. A spring assembly for a mattress, in which an outermost coil spring of a spring array is secured in a space between upper and lower border wires and by pins, and helical coils are disposed in row directions on upper and lower portions of the spring array to knit an adjacent coil spring, such that each coil spring has a free terminal convolution protruded from an upper portion of the upper border wire and/or a lower portion of the lower border wire, the spring assembly comprising:

an enclosure provided in the column direction on an upper end portion and/or a lower end portion of the coil spring for covering the terminal convolution from the adjoining border wire to the free end of the terminal convolution protruded therefrom, thereby interrupting interference between the terminal convolution and the upper and/or lower border wire and underlying coil spring and absorbing a lateral load applied to the terminal convolution.

7. The spring assembly as claimed in claim 6, wherein the enclosure is any one of polyurethane foam and non-woven fabric.

8. The spring assembly as claimed in claim 6, wherein the enclosure is a non-woven fabric, and the non-woven fabric includes a lower non-woven fabric disposed in the column direction under a lower portion of the terminal convolution and an upper non-woven fabric disposed in the column direction on an upper portion of the terminal convolution, in which the upper non-woven fabric is tacked on or joined to the lower non-woven fabric.

9. The spring assembly as claimed in claim 6, wherein the enclosure is a non-woven fabric, and the non-woven fabric includes a lower non-woven fabric disposed in the column direction under a lower portion of the helical coil and an upper non-woven fabric disposed in the column direction on an upper portion of the terminal convolution, in which the upper non-woven fabric is tacked on or joined to the lower non-woven fabric.

10. The spring assembly as claimed in claim 6, wherein the non-woven fabric includes an upper non-woven fabric faced to another non-woven fabric to cover an upper portion of the terminal convolution along the column direction, in which a front end portion of the upper non-woven fabric is wound around the terminal convolution to cover a lower portion of the terminal convolution and is tacked on or joined to an adjoining surface of the upper non-woven fabric.

11. A spring assembly for a mattress, in which an outermost coil spring of a spring array is secured in a space between upper and lower border wires and by pins, and helical coils are disposed in row directions on upper and lower portions of the spring array to knit an adjacent coil spring, such that each coil spring has a free terminal convolution protruded from an upper portion of the upper border wire and/or a lower portion of the lower border wire, the spring assembly comprising:

an enclosure provided on an upper end portion and/or a lower end portion of the coil spring for covering the terminal convolution from the adjoining border wire to the free end of the terminal convolution protruded therefrom by a piece, thereby interrupting interference between the terminal convolution and the upper and/or lower border wire and underlying coil spring and absorbing a lateral load applied to the terminal convolution.

12. The spring assembly as claimed in claim 11, wherein the enclosure is any one of polyurethane foam and non-woven fabric.

13. The spring assembly as claimed in claim 11, wherein the enclosure is a non-woven fabric, and the non-woven fabric includes a lower non-woven fabric disposed under a lower portion of the terminal convolution by a piece and an upper non-woven fabric disposed on an upper portion of the terminal convolution by a piece, in which the upper non-woven fabric is tacked on or joined to the lower non-woven fabric.

14. A spring assembly for a mattress, in which an outermost coil spring of a spring array is secured in a space between upper and lower border wires and by pins, and helical coils are disposed in row directions on upper and lower portions of the spring array to knit an adjacent coil spring, such that each coil spring has a free terminal convolution protruded from an upper portion of the upper border wire and/or a lower portion of the lower border wire, the spring assembly comprising:

an enclosure fully provided on upper end portions and/or lower end portions of the coil springs for covering the terminal convolution from the adjoining border wire to the free end of the terminal convolution protruded therefrom, thereby interrupting interference between the terminal convolution and the upper and/or lower border wire and underlying coil spring and absorbing a lateral load applied to the terminal convolution.

15. The spring assembly as claimed in claim 14, wherein the enclosure is any one of polyurethane foam and non-woven fabric.

16. The spring assembly as claimed in claim 14, wherein the enclosure is a non-woven fabric, and the non-woven fabric includes an upper non-woven fabric covering the upper portion of the spring array to fully enclose an upper portion of the terminal convolution, in which an end portion of the upper non-woven fabric is tacked on or joined to a convolution of the terminal convolution.

17. The spring assembly as claimed in claim 14, wherein the enclosure is a non-woven fabric, and the non-woven fabric includes an upper non-woven fabric fully covering the upper portion of the spring array, in which an end portion of the upper non-woven fabric is tacked on or joined to the upper border wire or the lower border wire.

18. The spring assembly as claimed in claim 2, wherein the enclosure is a non-woven fabric, and the non-woven fabric includes a lower non-woven fabric disposed in the row direction under a lower portion of the terminal convolution and an upper non-woven fabric disposed in the row direction on an upper portion of the terminal convolution, in which the upper non-woven fabric is tacked on or joined to the lower non-woven fabric.

19. The spring assembly as claimed in claim 2, wherein the enclosure is a non-woven fabric, and the non-woven fabric includes a lower non-woven fabric disposed in the row direction under a lower portion of the helical coil and an upper non-woven fabric disposed in the row direction on an upper portion of the terminal convolution, in which the upper non-woven fabric is tacked on or joined to the lower non-woven fabric.

20. The spring assembly as claimed in claim 2, wherein the enclosure is a non-woven fabric, and a non-woven fabric includes an upper non-woven fabric faced to another non-woven fabric to cover an upper portion of the terminal convolution along the row direction, in which a front end portion of the upper non-woven fabric is wound around the terminal convolution to cover a lower portion of the terminal convolution and is tacked on or joined to an adjoining surface of the upper non-woven fabric and which another terminal convolution is covered in the same manner.

21. The spring assembly as claimed in claim 7, wherein the enclosure is a non-woven fabric, and the non-woven fabric includes a lower non-woven fabric disposed in the column direction under a lower portion of the terminal convolution and an upper non-woven fabric disposed in the column direction on an upper portion of the terminal convolution, in which the upper non-woven fabric is tacked on or joined to the lower non-woven fabric.

22. The spring assembly as claimed in claim 7, wherein the enclosure is a non-woven fabric, and the non-woven fabric includes a lower non-woven fabric disposed in the column direction under a lower portion of the helical coil and an upper non-woven fabric disposed in the column direction on an upper portion of the terminal convolution, in which the upper non-woven fabric is tacked on or joined to the lower non-woven fabric.

23. The spring assembly as claimed in claim 7, wherein the non-woven fabric includes an upper non-woven fabric faced to another non-woven fabric to cover an upper portion of the terminal convolution along the column direction, in which a front end portion of the upper non-woven fabric is wound around the terminal convolution to cover a lower portion of the terminal convolution and is tacked on or joined to an adjoining surface of the upper non-woven fabric.

24. The spring assembly as claimed in claim 12, wherein the enclosure is a non-woven fabric, and the non-woven fabric includes a lower non-woven fabric disposed under a lower portion of the terminal convolution by a piece and an upper non-woven fabric disposed on an upper portion of the terminal convolution by a piece, in which the upper non-woven fabric is tacked on or joined to the lower non-woven fabric.

25. The spring assembly as claimed in claim 15, wherein the enclosure is a non-woven fabric, and the non-woven fabric includes an upper non-woven fabric covering the upper portion of the spring array to fully enclose an upper portion of the terminal convolution, in which an end portion of the upper non-woven fabric is tacked on or joined to a convolution of the terminal convolution.

26. The spring assembly as claimed in claim 15, wherein the enclosure is a non-woven fabric, and the non-woven fabric includes an upper non-woven fabric fully covering the upper portion of the spring array, in which an end portion of the upper non-woven fabric is tacked on or joined to the upper border wire or the lower border wire.

* * * * *